US005203743A

United States Patent [19]

Hou et al.

[11] Patent Number: 5,203,743

[45] Date of Patent: * Apr. 20, 1993

[54] ORNAMENTAL CAROUSEL ASSEMBLY

[75] Inventors: Jack Hou; I-Pin Feng, both of Taipei, Taiwan

[73] Assignee: Giftec, Ltd., Alexandria, Va.

[ * ] Notice: The portion of the term of this patent subsequent to Jan. 7, 2009 has been disclaimed.

[21] Appl. No.: 915,756

[22] Filed: Jul. 21, 1992

Related U.S. Application Data

[63] Continuation-in-part of Ser. No. 714,729, Jun. 13, 1991, abandoned, which is a continuation-in-part of Ser. No. 577,773, Sep. 5, 1990, Pat. No. 5,078,386.

[51] Int. Cl.[5] ..... A63H 13/20

[52] U.S. Cl. ..... 472/7; 472/12; 74/49; 74/50

[58] Field of Search ..... 472/6–12; 74/49, 50

[56] References Cited

U.S. PATENT DOCUMENTS

| | | |
|---|---|---|
| 546,912 | 9/1895 | Boettcher . |
| 1,271,892 | 7/1918 | Habeshan . |
| 1,635,108 | 7/1927 | Bluthardt . |
| 2,657,928 | 11/1953 | McDonald . |
| 2,846,223 | 8/1958 | Nelson . |
| 3,112,929 | 12/1963 | Gisser . |
| 3,191,930 | 6/1965 | Cottrell et al. . |
| 3,897,054 | 7/1975 | Riggs . |
| 4,753,436 | 6/1988 | Sinclair . |
| 4,925,182 | 5/1990 | Hou . |
| 5,078,386 | 1/1992 | Hou et al. . |

*Primary Examiner*—Richard E. Chilcot, Jr.
*Attorney, Agent, or Firm*—Bacon & Thomas

[57] ABSTRACT

An ornamental carousel assembly is disclosed which simulates the movements of a full-size carousel by supporting various carousel figures that both reciprocate vertically and revolve around a central vertical support column along with a canopy. The rotating and reciprocating ornaments are supported on a central support assembly by a bearing arrangement which minimizes the friction developed during movement of the ornamental elements so as to permit a miniature wind-up music box mechanism to drive the carousel. The drive assembly from the miniature wind-up music box mechanism includes a gear drive assembly for transferring drive from an output shaft of the miniature wind-up music box mechanism to rotate and reciprocate the various ornamental figures and a spring which is used to impart the necessary rotary drive force to the canopy. The inclusion of the spring serves not only to drive the canopy but also provides a safety feature wherein the canopy is permitted to flex in order to prevent damage of the canopy during transit and handling especially when heavy ceramic canopies are utilized.

27 Claims, 5 Drawing Sheets

ORNAMENTAL CAROUSEL ASSEMBLY

RELATED PATENT APPLICATION

This application is a continuation-in-part of application Ser. No. 07/714,729, filed Jun. 13, 1991 now abandoned, which is a continuation-in-part of U.S. Ser. No. 07/577,773 filed on Sep. 5, 1990 entitled "Ornamental Carousel Assembly," now U.S. Pat. No. 5,078,386.

BACKGROUND OF THE INVENTION

1. Field of the Invention

The present invention generally involves the field of technology pertaining to devices for imparting different movements to a plurality of ornaments while accompanying such movements with music. More specifically, the invention relates to an improved ornamental carousel assembly wherein rotational and vertical movements are imparted to a plurality of ornaments and a canopy by a miniature wind-up music box mechanism.

2. Description of the Prior Art

It is known in the art to rotatably support an ornament on a base containing a wind-up music box mechanism. Devices of this type are often provided with plural ornaments and may even include a canopy formed from a fragile material, such as ceramic, which may be easily broken and impart considerable weight to the device. When such a device has rotating elements formed from rather heavy materials, a large amount of force must be exerted by the wind-up music box mechanism in order to perform the rotational and vertical movements desired.

Many prior art devices have overcome the inability of a miniature wind-up music box mechanism to develop the required force to rotate and reciprocate the elements of an ornamental display assembly by utilizing an electric drive motor which is driven by a power supply also housed in the base. An example of such an arrangement is represented by U.S. Pat. No. 4,753,436. Electrically driven motors, although they can more easily develop higher levels of torque output, are generally more bulky and less efficient than wind-up music box mechanisms.

SUMMARY OF THE INVENTION

It is the object of the present invention to provide an improved device for imparting movement to a plurality of ornaments supported on a base by means of a miniature wind-up music box mechanism.

It is another object of the invention to provide an improved ornamental carousel assembly wherein the rotating and reciprocating elements may be driven by a miniature wind-up music box mechanism.

It is still another object of the invention to provide an improved ornamental carousel assembly wherein rotational and vertical movements are imparted to a plurality of ornaments and rotational movement is imparted to a canopy to produce a display that captures the interest of a viewer for a long period of time.

These and other objects of the invention are realized by providing an ornamental carousel assembly wherein the rotating and reciprocating elements are rotatably supported by a bearing assembly which minimizes the friction developed during movement of the elements so as to permit a miniature wind-up music box mechanism to drive the carousel. Furthermore, a unique drive transmission assembly is provided having an elongated drive transmitting rod connected to an output shaft of the miniature wind-up music box mechanism and which transmits to a gear drive assembly in order to carry out the desired rotational and vertical movements of the various carousel elements. Also provided on the drive transmitting rod is a resilient portion which supports the carousel canopy. The resilient portion not only imparts a rotary driving force to the canopy but also permits the canopy support to flex and prevent damage to the canopy during transit and handling, especially when heavy ceramic canopies are utilized.

Other objects, features and advantages of the invention shall become apparent from the following detailed description of a preferred embodiment thereof, when taken in conjunction with the drawings wherein like reference characters refer to corresponding parts in the several views.

DETAILED DESCRIPTION OF THE PREFERRED EMBODIMENT

Figure 1:
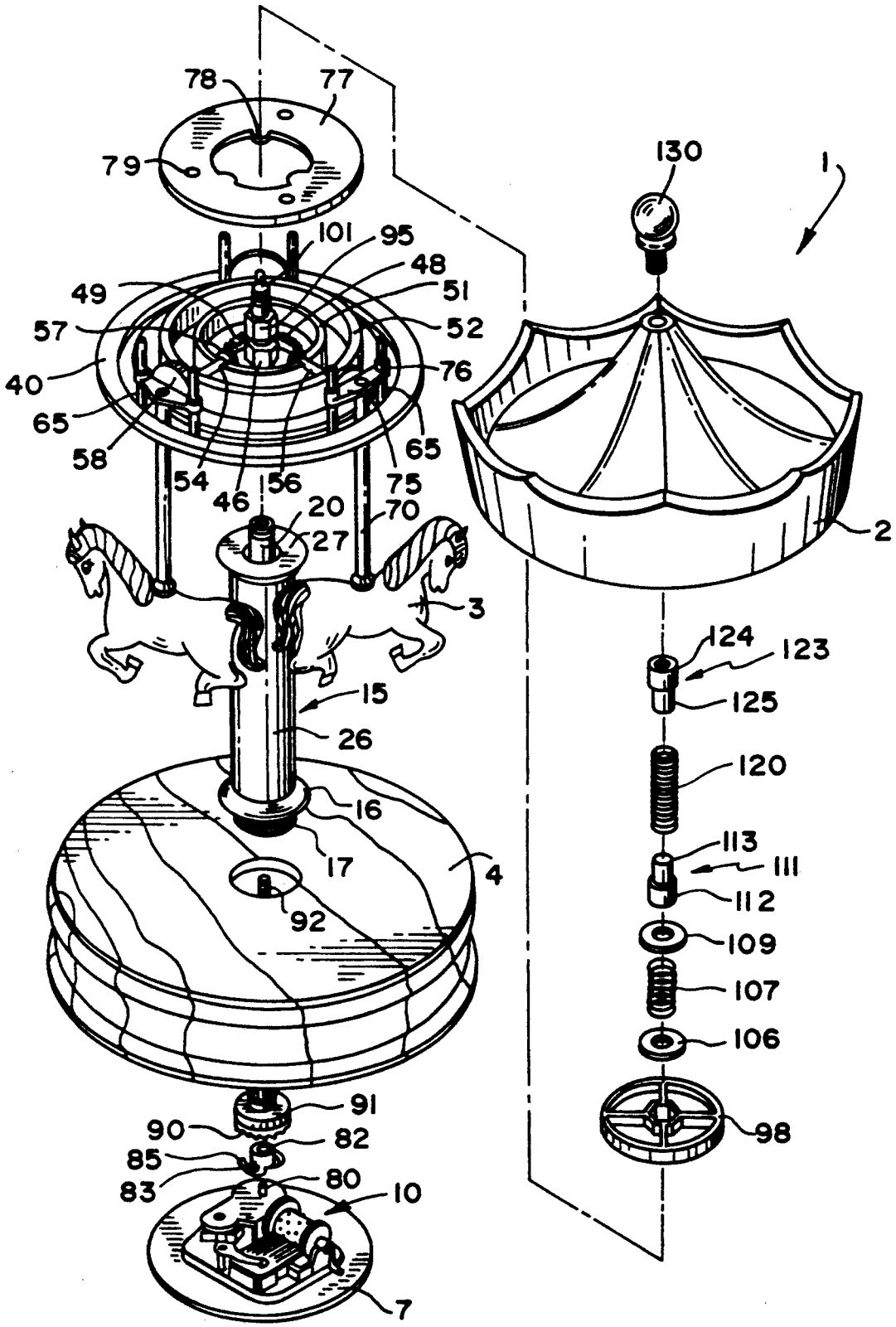
FIG. 1 is an exploded perspective view of a first embodiment of an ornamental carousel assembly according to a preferred embodiment of the invention.

An ornamental carousel assembly 1 according to a preferred embodiment of the invention shall now be described with initial reference to FIGS. 1 and 2. As shown therein, carousel assembly 1 includes a canopy 2, and a plurality of ornaments 3, being shown in the configuration of horses, and a base stand 4. The bottom of the base stand 4 includes a plurality of rubber legs 5 for supporting the ornamental carousel assembly 1 on a horizontal surface. Located in the bottom of the base stand 4 is a box insert 6 having a base wall portion 7 to which is mounted a miniature music box 10.

Extending above the base stand 4 is an upright support assembly 15. Upright support assembly 15 includes a lower end cap 16 having threads 17 which secures the lower end cap 16 to base stand 4. Fixedly attached at its lower end to the lower end cap 16 is an elongated tubular support shaft 20. The upper end of the tubular support shaft 20 threadably receives a bearing support member 22 (FIG. 3) having a threaded lower portion 23 and a reduced diameter upper portion 24. Concentrically arranged about the tubular support shaft 20 is an ornamental tubular sleeve 26 which is received, at one end, in lower end cap 16 and, at its other end, in upper end cap 27. As best shown in FIG. 2, upper end cap 27 fits snugly onto lower portion 23 of bearing support 22.

The manner in which the ornaments are supported for movement on the carousel assembly shall now be described with reference to FIGS. 2 and 3. Snugly received on bearing support 22 is a bearing assembly 30. Bearing assembly 30 includes an inner sleeve member 32 which extends between reduced diameter upper portion 24 of bearing support 22 and upper end cap 27, as best shown in FIG. 2. Bearing assembly 30 includes an outer rotary bearing member 33 which rotates with minimal friction relative to inner sleeve member 32 due to a plurality of balls 34 therebetween. As clearly shown in FIGS. 1 and 2, the ornaments 3 are supported by a ceiling plate 40. Ceiling plate 40 includes a cavity 42 on its lower side thereof which snugly receives outer rotary bearing member 33 of bearing assembly 30. Due to this arrangement, ceiling plate 40 is permitted to rotate relative to base stand 4 and the upright support assembly 15 with minimal friction.

Figure 2:
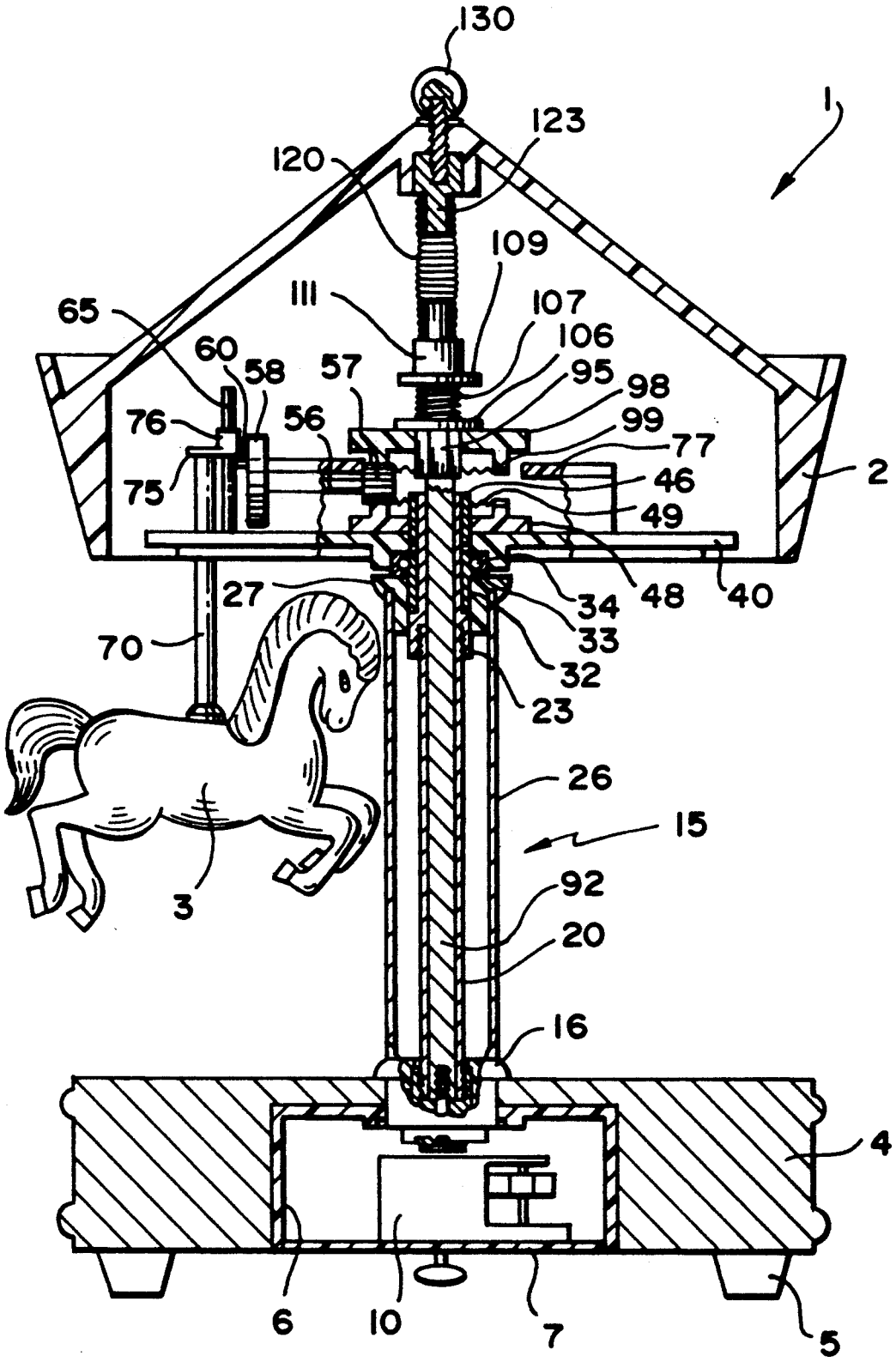
FIG. 2 is a vertical cross-sectional view of the carousel assembly shown in FIG. 1 in its assembled state.
Figure 3:
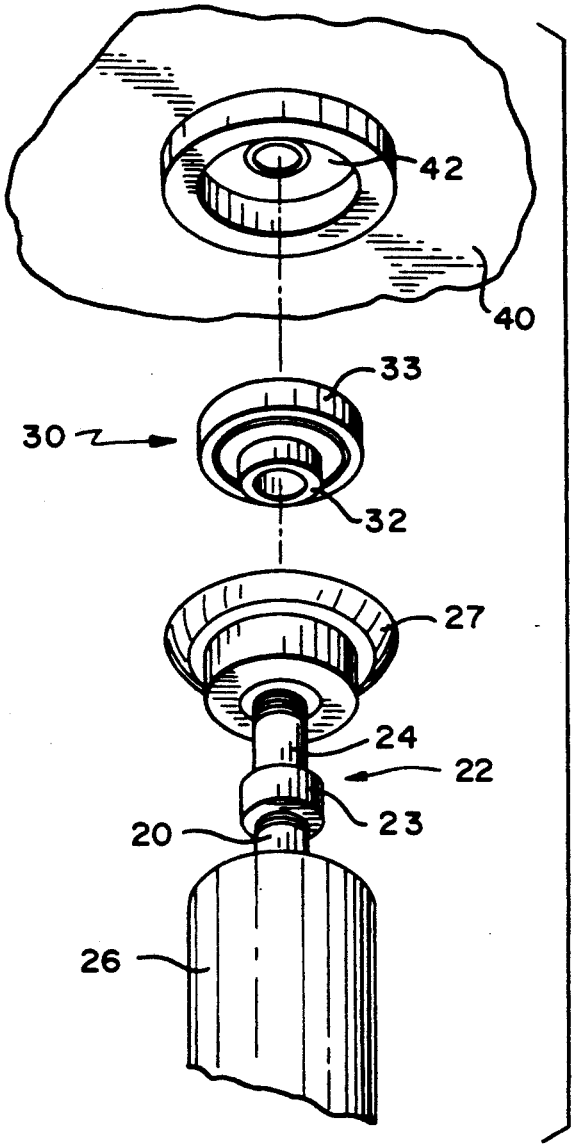
FIG. 3 is an exploded perspective view showing the interconnection of the rotational support elements for the carousel assembly shown in FIGS. 1 and 2.

Reference will now be made particularly to FIGS. 1 and 2 in describing the manner in which the drive is transmitted from the miniature music box 10 to the moving elements of the ornamental carousel assembly 1. A nut sleeve 46 is functionally secured on the top of the reduced diameter upper portion 24 of bearing support 22. Non-rotatably attached to nut sleeve 46 is a first circular gear rack 48 having a circular array of gear teeth 49 which extends upwardly about a circumferential surface thereof. As best shown in FIG. 1, ceiling plate 40 includes an inner upstanding circular wall portion 51 and an outer upstanding circular wall portion 52. At predetermined locations about the inner and outer upstanding circular wall portions 51, 52 are formed aligned, circumferentially spaced grooves 54. Located within each pair of aligned spaced grooves 54 is a rotary driven shaft 56. Each driven shaft 56 is fixed at one end thereof to a pinion gear 57 and at the other end thereof to a driven disk 58. As best shown in FIG. 2, each driven disk includes an outwardly projecting stub shaft 60 extending substantially parallel to rotary driven shaft 56 but eccentrically offset from the drive axis thereof.

Each of these rotary driven shafts 56 are driven in a manner which will be explained more fully below and function to rotate the ceiling plate 40 while simultaneously reciprocating the various ornaments 3. Before continuing with the description of the drive from the miniature music box 10 to the ceiling plate 40 and ornaments 3, the manner in which the ornaments 3 are supported and driven for reciprocating movement and the manner in which the rotary driven shafts 56 are secured, both vertically and axially, within circumferentially spaced grooves 54 will now be described.

Evenly spaced about each pair of aligned circumferentially spaced grooves 54 is a pair of upstanding guide rails 65. Each ornament 3 is mounted to an elongated support rod 70 which extends through an aperture (not shown) in ceiling plate 40 and is fixedly secured to one apex of a triangular shaped follower plate 75. At the other two apexes of the triangular shaped follow plate 75 are formed integral guide sleeve portions 76 which slidably secure upstanding guide rails 65 there through. The underside of each triangular shaped follower plate 75 is engaged by a corresponding outwardly projecting stub shaft 60 of a driven disk 58. From viewing FIG. 2, it can be readily seen that due to the parallel but offset axis of the rotary driven shaft 56 and outwardly projecting stub shaft 60, rotation of rotary driven shaft 56 will result in vertical reciprocation of ornament 3 along guide rails 65. Also note from FIG. 2 that, due to the triangular configuration of the follower plate 75, the elongated support rod 70 is offset from upstanding guide rails 65 and outwardly projecting stub shaft 60 so as not to hinder the drive transfer.

Referring back to FIG. 1, secured to ceiling plate 40 by connection means (not shown) which may extend through mounting holes 79 is a cover plate 77 which rests on outer upstanding circular wall portion 52. Cover plate 77 also includes a plurality of tabs 78 extending inwardly therefrom which rest on top of inner upstanding circular wall portion 51. Each of the tabs 78 is located above a respective rotary driven shaft 56 such that, by the mounting of cover plate 77, the vertical and horizontal movements of rotary driven shafts 56 are restricted and pinion gears 57 remain in contact with the gear teeth 49 of first circular gear rack 48. At this time, it should be noted that although in the preferred embodiment three ornamental horses are depicted, any number and type of ornaments can be supported and driven in the manner described above.

Miniature music box 10 is of conventional design and is known in the art as having an external handle which may be used to wind a spring in order to rotate a flywheel to drive an output shaft which, in turn, also drives a shaft of a music generating assembly. Since such miniature wind-up music boxes are known in the art, each particular component of music box 10 will not be fully described herein.

Continuing with the description of the manner in which drive power is transmitted to pinion gears 57 of rotary drive shafts 56, miniature music box 10 includes an output shaft 80 having secured thereto a ring 82. Formed integral with ring 82 are various resilient drive arms 83, each ending in an upwardly projecting drive tooth which engage with teeth 90 of a ratchet cog 91 to form a one-way drive clutch. The use of the ratchet mechanism enables winding of the music box 10 without rotation of the ratchet cog 91. Rotation of ring 82 with output shaft 80 as the music box is being wound will cause the drive teeth of drive arms 83 to slip over teeth 90 of ratchet cog 91 without imparting rotational movement to ratchet cog 91. Rotation of ring 82 in the opposite direction will cause drive teeth of drive arms 83 to engage teeth 90 so as to impart rotational movement to ratchet cog 91.

Secured to ratchet cog 91 is a drive transmitting rod 92 which extends through upright support assembly 15, ceiling plate 40 and first circular gear rack 48, as clearly shown in FIG. 2. Secured to the upper end of drive transmitting rod 92 is a drive nut 95. Drive nut 95 has mounted thereon for rotation therewith a second circular gear rack 98 having downwardly extending gear teeth 99. As best shown in FIG. 2, gear teeth 99 engage with the gear teeth of pinion gears 57 such that pinion gears 57 are sandwiched between first and second circular gear racks 48 and 98. Since drive transmitting rod 92 is directly driven by output shaft 80 through the ratchet mechanism second circular gear rack 98 rotates in unison with the drive transmitting rod 92, it should be evident that drive from output shaft 80 is transmitted through drive transmitting rod 92 and second circular gear rack 98 to pinion gears 57 and rotary driven shafts 56. Since pinion gears 57 are driven around the circumference of fixed first circular gear rack 48, rotation of second circular gear rack 98 results in rotation of ceiling plate 40. Since ornaments 3 are attached to ceiling plate 40, these elements rotate as well. Furthermore, since movement of pinion gears 57 results in rotation of rotary driven shaft 56, driven disk 58 and outwardly projecting stub shaft 60, rotation of second circular gear rack 98 also results in vertical reciprocating movement of ornaments 3 along upstanding guide rails 65.

Secured to or integrally formed with drive nut 95 is an upwardly arranged drive rod extension 101. About drive rod extension 101 is sequentially arranged a first washer 106, a biasing spring 107, a second washer 109 and a first threaded cap 111. Each of these elements are diametrically arranged such that washer 106 abuts against an upper surface of drive nut 95 and washer 109 abuts against first threaded cap 111 with biasing spring 107 retained therebetween. When assembled, the lower portion of washer 106 abuts an upper portion of second circular gear rack 98 and, due to the presence of biasing spring 107, biases second circular gear rack 98 downwardly into engagement with pinion gears 57. The presence of biasing spring 107 also aids in the distribution of torque from second circular gear rack 98 to pinion gears 57 by enabling second circular gear rack 98 to flex during drive transmission.

First threaded cap portion 111 includes a first larger diameter portion 112 which is secured to drive rod extension 101 in the manner discussed above and a second reduced diameter portion 113 (see FIG.1). Onto second reduced diameter portion 113 is frictionally fit a drive and safety spring 120. A second threaded cap 123 also includes a first larger diameter portion 124 and a second reduced diameter portion 125. Second diameter portion 125 is also frictionally fit within spring 120. First diameter portion 124 of second threaded cap 123 supportably mounts canopy 2 which is secured to second threaded cap 123 by means of an ornamental threaded top bolt 130. Due to the frictional fit between spring 120 and the reduced diameter portions of first threaded cap 111 and second threaded cap 123, spring 120 rotates in unison with drive transmitting rod 92. Therefore, spring 120 not only enables canopy 2 to be rotated in unison with ceiling plate 40 and ornaments 3 but also provides a resilient connection of the canopy to the drive transmitting rod 92. This feature is extremely important especially when heavy canopies are utilized, such as those made from ceramic. Not only will such heavy canopies tend to oscillate during rotation to a certain degree due to imperfect symmetry which can be taken up by spring 120 instead of being transmitted downward through the drive assembly, but the spring also permits the canopy to flex and prevents damage during handling and in transit.

Based on the above description, it can be readily seen that due to the presence of bearing assembly 30, the ceiling plate 40, the ornaments can be driven by the miniature wind-up music box 10 since minimal frictional resistance exists. Also, due to the assembly arrangement, the presence of the bearing assembly 30 minimizing the overall height of carousel assembly 1, which is highly desirable. The particular drive system of the present invention also provides for a reliable and easily assembled drive transmission arrangement. Furthermore, the inclusion of spring 120 serves not only as a safety feature but also is an integral part of the carousel's drive and support assembly.

Figure 6:
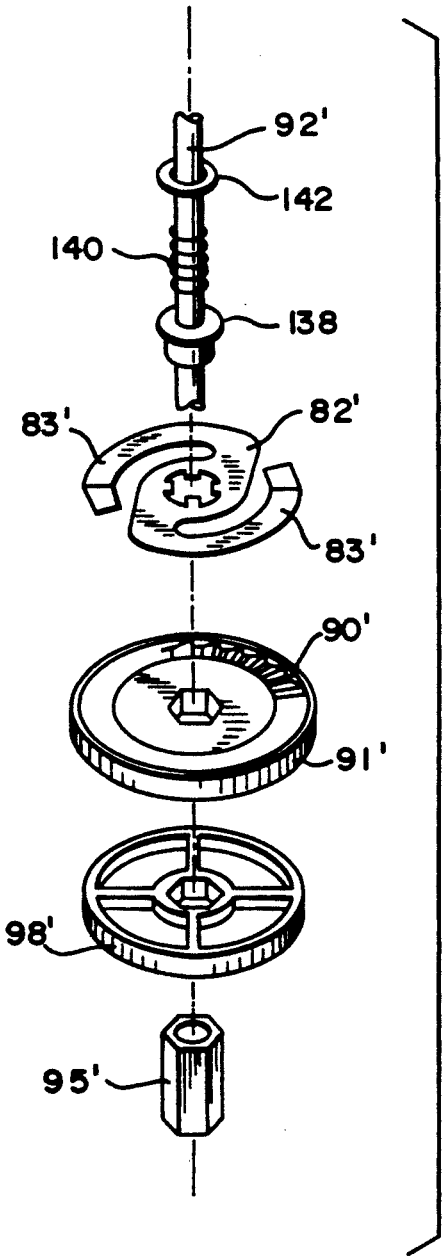
FIG. 6 is a partial, exploded, perspective view of the drive assembly shown in FIG. 4.
Figure 4:
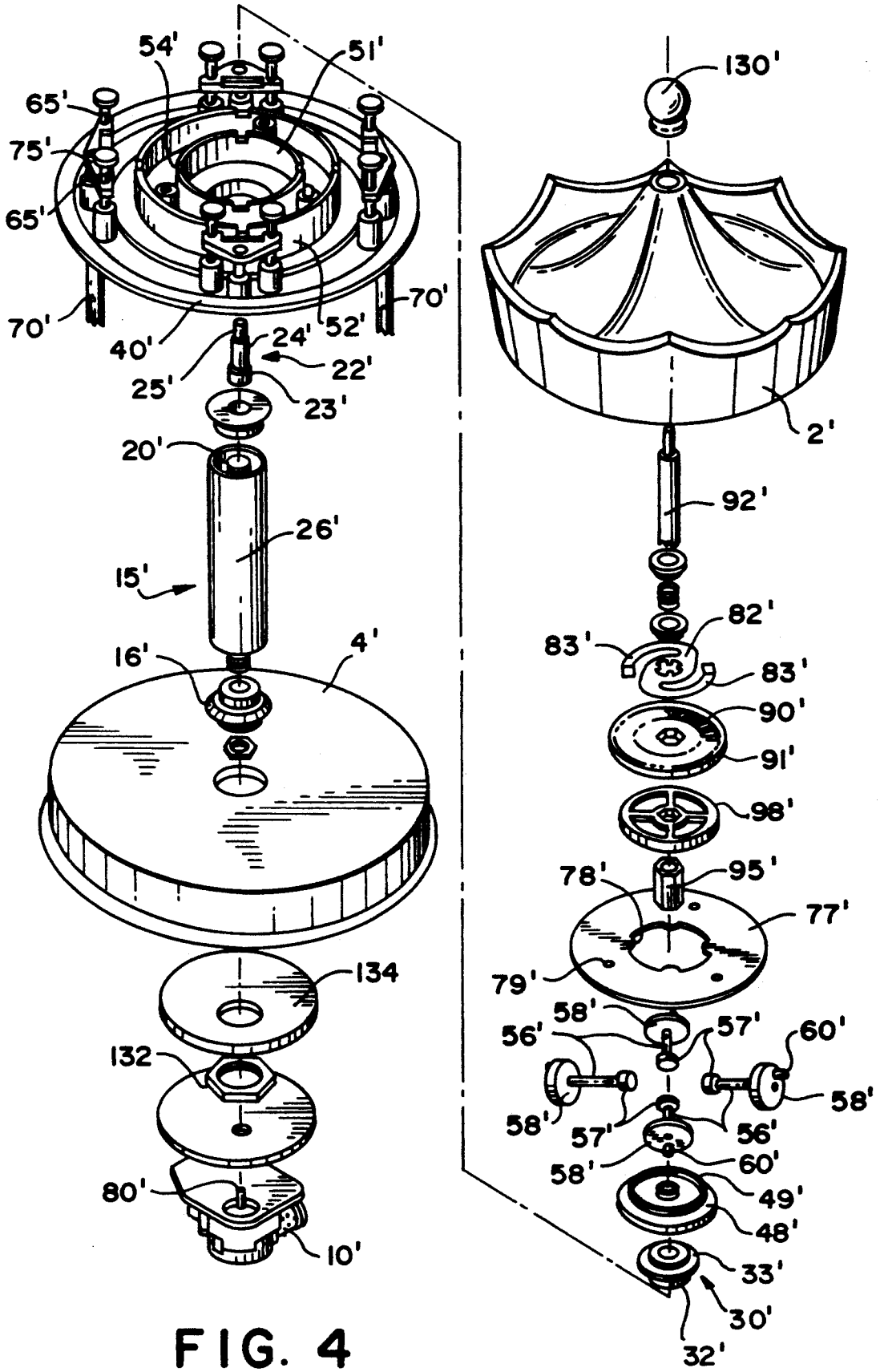
FIG. 4 is an exploded, perspective view of a second embodiment of an ornamental carousel assembly according to the invention.
Figure 5:
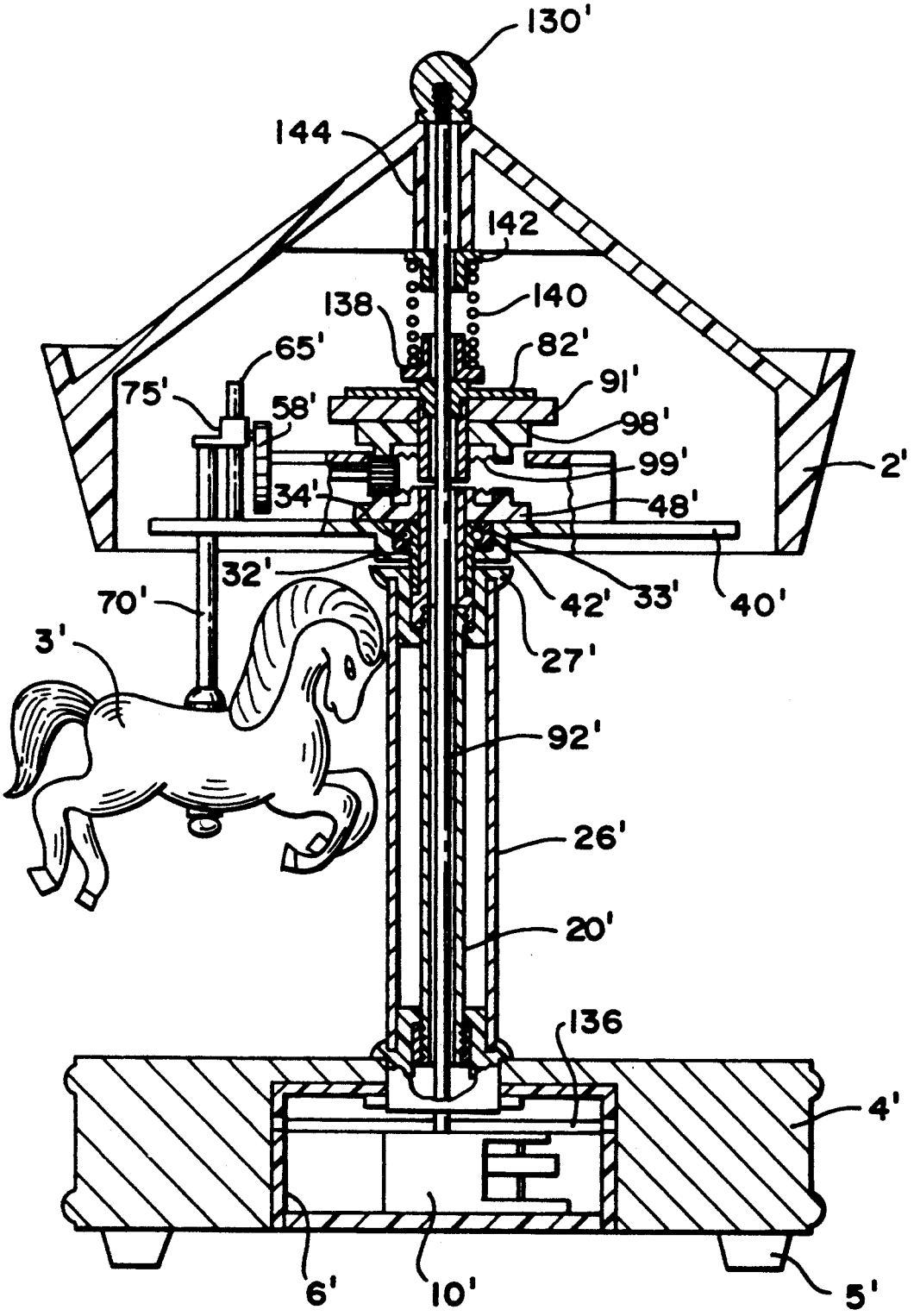
FIG. 5 is a vertical cross-sectional view of the assembled carousel assembly shown in FIG. 4.

An alternative embodiment of the carousel assembly is illustrated in FIGS. 4–6. In these figures, the elements of the carousel similar to those in the previously described embodiment have been denoted by the same number with a prime added.

As can be seen in FIGS. 4 and 5, this embodiment includes a base stand 4' to which is attached miniature music box 10' has an output shaft 80' which is drivingly attached to drive transmitting rod 92'. In the embodiment, the drive transmitting rod 92' is directly attached to the output shaft 80' unlike the previously described embodiment in which these elements were connected through the inter engagement of ring 82 and ratchet cog 91.

A lower end cap 16' attached to base stand 4' by nut 132 and washer 134. Mounting plate 136 may attach the music box 10' to box insert 6'.

Tubular sleeve 26', which forms a part of the upright support assembly 15', is fixedly attached at its lower end to the lower end cap 16' and its upper end threadingly connected to bearing support member 22'. Bearing support member 22', as in the previous embodiment, has a threaded lower portion 23' and a reduced diameter upper portion 24'. Upper end cap 27' fits over the upper end of tubular sleeve 26' and extends around bearing support 22'.

Bearing assembly 30' includes an outer rotary bearing member 33' which may rotate with minimal friction relative to inner sleeve member 32' due to ball bearings 34' located between these elements. Inner sleeve member 32' is fixedly mounted on reduced diameter portion 24' of the bearing support 22'. Ceiling plate 40' defines a cavity 42' which snugly receives the outer rotary bearing member 33' which enables the ceiling plate 40' to rotate relative to the base stand 4' and the upright support assembly 15' with minimal friction.

A first circular gear rack 48' having a circular array of gear teeth 49' is attached to an upper portion 25' of the bearing support 22'.

The structure and function of the ceiling plate 40', the rotary driven shafts 56', the pinion gears 57' the driven disks 58' the stub shaft 60', the guiderails 65', the support rods 70' and the follower plates 75' are the same as the corresponding elements in the previously described embodiment. Pinions 57' are engaged with the circular array of gear teeth 49' such that relative movement between these elements rotates shafts 56' as well as driven disks 58', which rotation, in turn, cause reciprocation of the support rods 70' on which are mounted ornaments 3'.

Cover plate 77' rests on an outer upstanding circular wall 52' of the ceiling plate 40' and includes tabs 78' located above a respective rotary shaft 56' such that the mounting of the cover plate 77' restricts the vertical and horizontal movements of the rotary driven shafts 56'. The structure and function of the driving elements are the same as in the previously described embodiment, except that FIG. 4, illustrates the use of four such drive mechanisms, whereas the embodiment in FIG. 1 utilized only three such mechanisms.

Drive transmitting rod 92' extends through tubular support shaft 20' and has a lower end attached to music box output shaft 80' and an upper end attached to canopy 2' by decorative nut 130'. Drive nut 95' is located about an upper portion of the drive transmitting rod 92'. Upper circular gear rack 98' is fixedly attached to the drive nut 95' such that it rotates therewith. Again, circular gear rack 98' has downwardly extending gear teeth 99' which drivingly engage the pinion gears 57'. As in the previously described embodiment, rotation of the drive transmitting rod 92' will cause rotation of the upper circular gear rack 98' through drive nut 95' which will cause pinion gears 57' to rotate around lower gear rack 48'. Such movement causes a rotation of the ceiling plate 40' as well as the reciprocating movement of the ornaments 3'.

Contrary to the previously described embodiment, the present embodiment utilizes a one-way drive clutch mechanism adjacent to the ceiling plate assembly to enable winding of the music box mechanism 10' without causing rotation of the ceiling plate 40'. Ratchet cog 91' has a plurality of ratchet teeth 90' on upper surfaces thereof which face ring 82' having a plurality of resilient drive arms 83'. Each of the resilient drive arms 83' ends in a downwardly projecting drive tooth which engages teeth 90'. Ring 82' is attached to drive transmitting rod 92' will rotate in a first direction which will cause the drive teeth of the resilient drive arms 83' to slip over the teeth 90' without imparting rotational movement to the ratchet cog 91'. Ratchet cog 91' is drivingly connected to the upper circular gear rack 98' through drive nut 95'. Since both of these members are stationary, no rotational movement is imparted to the ceiling plate 40'.

When the drive transmitting rod 92' rotates in a second, opposite direction, the teeth on the ends of resilient arms 83' drivingly engage the teeth 90' so as to impart rotation to the ratchet cog 91' as well as the upper circular gear rack 98'. As noted previously, such rotational movement of the gear rack 98' imparts rotational movement to the ceiling plate 40' and reciprocating movement to the ornaments 3'.

A collar 138 is also fixedly attached to the drive transmitting rod 92' and bears against one end of a spring 140 which is concentrically arranged around the drive transmitting rod 92'. An upper collar 142 is slidably located on drive transmitting rod 92' and bears against an upper end of spring 140. As can be best seen in FIG. 5, the canopy 2' has an inwardly extending sleeve portion 144 which bears against an upper portion of collar 142 such that the spring 140 supports the canopy 2'.

It is to be understood the forms of the invention herein shown and described are to be taken as a preferred embodiments thereof and various changes in shape, material, size and arrangement of parts may be resorted to without departing from the spirit of the invention or scope of the following claims.

We claim:

1. An ornamental carousel assembly of the type wherein a plurality of ornaments are mounted on a rotating ceiling plate comprising:

(a) a base;

(b) a wind-up type drive and music box mechanism secured to said base and including an output shaft;

(c) a tubular support assembly extending upright from and supported by said base;

(d) bearing means having an inner sleeve member non-rotatably secured to an upper portion of said tubular support assembly and an outer rotary bearing member;

(e) a ceiling plate attached to said outer rotary bearing member, said ceiling plate having means to support a plurality of ornaments; and, (f) drive transmitting means interconnected between said output shaft and said ceiling plate for rotating said ceiling plate on said bearing means relative to said tubular support assembly.

2. The ornamental carousel assembly of claim 1 wherein said ceiling plate includes a cavity on the lower side thereof which snugly receives said outer rotary bearing member.

3. The ornamental carousel assembly of claim 1 further including a canopy and means for drivingly connecting the canopy to said drive transmitting means for rotation therewith.

4. The ornamental carousel assembly of claim 3 wherein said means for drivingly connecting the canopy to said drive transmitting means includes a spring.

5. The ornamental carousel assembly of claim 1 wherein said plurality of ornaments are mounted for both reciprocating and rotary movement and said drive transmission means comprises:

a) a drive transmitting rod drivingly connected to said drive output shaft and extending upwardly through said tubular support assembly and said ceiling plate; and b) a drive transfer means including means drivingly engaged with said drive transmitting rod for imparting a reciprocating movement to said plurality of ornaments and rotary movement to said ceiling plate.

6. The ornamental carousel assembly of claim 5 further comprising a one-way drive clutch mechanism operatively interposed between the drive transmitting rod and the output shaft such that rotation of the output shaft in a first direction imparts rotation to the drive transmitting rod, while rotation of the output shaft in an opposite direction does not impart rotation to the drive transmitting rod.

7. The ornamental carousel assembly of claim 6 wherein the one-way clutch mechanism comprises:

a) a ratchet cog wheel drivingly associated with the drive transmitting rod, the ratchet cog wheel defining a plurality of ratchet teeth; and, b) a ring drivingly associated with the output shaft and having at least one resilient arm extending therefrom, the at least one resilient arm having a drive tooth located so as to engage the ratchet teeth on said ratchet cog wheel.

8. The ornamental carousel assembly of claim 5 wherein said drive transfer means comprises a gear drive assembly.

9. The ornamental carousel assembly of claim 8 wherein said drive assembly comprises:

a) a first circular gear rack fixed to said tubular support assembly;

b) a plurality of driven shafts rotatably supported on said ceiling plate, each of said driven shafts including a pinion gear fixed at one end thereof in engagement with said first gear rack;

c) a second circular gear rack also engaged with said pinion gears and located above said first circular gear rack; and, d) means drivingly connecting said second circular gear rack to said drive transmitting rod such that rotation of said drive transmitting rod by said output shaft causes rotation of said second circular gear rack, said driven shafts and said ceiling plate.

10. The ornamental carousel assembly of claim 9 further including a biasing spring located about a portion of said drive transmitting rod for biasing said second circular gear rack into engagement with said pinion gears.

11. The ornamental carousel assembly of claim 9 further comprising a disk secured to each of said driven shafts on an end opposite said pinion gear, each of said disks including an outwardly projecting stub shaft eccentrically offset from the axis of its respective driven shaft, said stub shaft engaging with a respective one of said means for mounting the plurality or ornaments such that rotation of said disk by said driven shaft results in a reciprocating movement of said ornaments.

12. An ornamental carousel assembly of claim 11 wherein each of said means for mounting an ornament comprise:

(a) a follower plate having a pair of guide sleeve portions being received about a pair of upstanding guide rails attached to said ceiling plate; and, (b) an elongated ornament support rod attached to said follower plate and including means for securing an ornament thereto.

13. The ornamental carousel assembly of claim 12 wherein said follower plate is generally triangular in shape with said guide sleeve portions being located at two apexes of the triangle and said support rod being secured at the third apex.

14. The ornamental carousel assembly of claim 9 wherein the means drivingly connecting said second circular gear rack to said drive transmitting comprises a one-way drive clutch mechanism such that rotation of the drive transmitting rod in a first direction imparts rotation to said second circular gear rack, while rotation of the drive transmitting rod in an opposite direction does not impart rotation to the second circular gear rack.

15. The ornamental carousel assembly of claim 14 wherein said one-way drive clutch mechanism comprises:

a) a ratchet cog wheel drivingly associated with the second circular gear rack, the ratchet cog wheel defining a plurality of ratchet teeth; and, b) a ring drivingly connected to said drive transmitting rod and having at least one resilient arm extending therefrom, the at least one resilient arm having a drive tooth located so as to engage the ratchet teeth on said ratchet cog wheel.

16. The ornamental carousel assembly of the type having a plurality of rotatable ornaments and a rotatable canopy comprising:

a) a base;

b) a wind-up type drive and music box mechanism secured to said base and including an output shaft;

c) a tubular support assembly extending upright from and supported by said base;

d) a ceiling plate rotatably supported on said tubular support assembly, said ceiling plate supporting said plurality of ornaments:

e) drive transmitting means interconnected between said output shaft and said ceiling plate for rotating said ceiling plate; and, f) a spring mounted for rotation with said drive transmitting means, said spring supporting said canopy for rotation therewith.

17. The ornamental carousel assembly of claim 16 wherein said ceiling plate is rotatably supported on said tubular support assembly by a bearing means having an inner sleeve member non-rotatably secured to an support portion of said tubular support assembly and an outer rotary member rotatable with said ceiling plate.

18. The ornamental carousel assembly of claim 17 wherein said ceiling plate defines a cavity for receiving said outer rotary bearing member.

19. The ornamental carousel assembly of claim 16 wherein said plurality of ornaments are mounted for both a reciprocating and rotary movement and said drive transmitting means comprises:

a) a drive transmitting rod drivingly connected to said drive output shaft and extending upwardly through said tubular support assembly and said ceiling plate; and b) a drive transfer means including means drivingly engaged with said drive transmitting rod for imparting a reciprocating movement to said plurality of ornaments and rotary movement to said ceiling plate.

20. The ornamental carousel assembly of claim 19 further comprising a one-way drive clutch mechanism operatively interposed between the drive transmitting rod and the output shaft such that rotation of the output shaft in a first direction imparts rotation to the drive transmitting rod, while rotation of the output shaft in an opposite direction does not impart rotation to the drive transmitting rod.

21. The ornamental carousel assembly of claim 20 wherein the one-way drive clutch mechanism comprises:

a) a ratchet cog wheel drivingly associated with the drive transmitting rod, the ratchet cog wheel defining a plurality of ratchet teeth; and, b) a ring drivingly associated with the output shaft and having at least one resilient arm extending therefrom, the at least one resilient arm having a drive tooth located so as to engage the ratchet teeth on said ratchet cog wheel.

22. The ornamental carousel assembly of claim 19 wherein said drive transfer means comprises a gear drive assembly.

23. The ornamental carousel assembly of claim 19 wherein said gear drive assembly comprises:

a) a first circular gear rack carried by said ceiling plate and fixed to said tubular support assembly;

b) a plurality of driven shafts rotatably supported on said ceiling plate, each of said driven shafts including a pinion gear fixed at one end thereof in engagement with said first gear rack;

c) a second circular gear rack also engaged with said pinion gears and located above said first circular gear rack; and, d) means drivingly connecting said second circular gear rack to said drive transmitting rod such that rotation of said drive transmitting rod by said output shaft causes rotation of said second circular gear rack, said driven shafts and said ceiling plate.

24. The ornamental carousel assembly of claim 23 further including a biasing spring located about a portion of said drive transmitting rod for biasing said second circular rack into engagement with said pinions.

25. The ornamental carousel assembly of claim 23 further comprising a disk secured to each of said driven shafts on an end opposite said pinion gear, each of said disks including an outwardly projecting stub shaft eccentrically offset from the axis of its respective driven shaft, said stub shaft engaging with a respective one of said means for mounting the plurality of ornaments such that rotation of said disk by said driven shaft results in a reciprocating movement of said ornaments.

26. The ornamental carousel assembly of claim 25 wherein each of said means for mounting an ornament comprises:

(a) a follower plate having a pair of guide sleeve portions being received about a pair of upstanding guide rails attached to said ceiling plate; and, (b) an elongated ornament support rod attached to said follower plate and including means for securing an ornament thereto.

27. The ornamental carousel assembly of claim 26 wherein said follower plate is generally triangular in shape with said guide sleeve portions being located at two apexes of the triangle and said support rod being secured at the third apex.

* * * * *

UNITED STATES PATENT AND TRADEMARK OFFICE

CERTIFICATE OF CORRECTION

PATENT NO. : 5,203,743

DATED : April 20, 1993

INVENTOR(S) : Jack HOU

It is certified that error appears in the above-identified patent and that said Letters Patent is hereby corrected as shown below:

Col. 7, between lines 31 and 32, insert the following paragraphs:

--Sleeve portion 144 defines a central opening having a diameter larger than that of the drive rod 92' such that the canopy 2' is slidable with respect to the drive rod 92' in a direction generally parallel to the longitudinal axis of the drive rod 92'. Spring 140, which may be a compression coil spring, extends around the drive rod 92' and, under normal conditions, biases the canopy 2' against a stop member, which in this particular instance comprises decorative nut 130'.

Although canopy 2' is illustrated having an integrally formed sleeve 144, it is to be understood that the canopy can be formed in a generally conical configuration and that the upper collar 142 may have a similar, conical configuration such that it may bear against the inner surface of the canopy 2'. As in the illustrated embodiment, a lower, planar surface of the conically shaped upper collar bears against the upper end of the coil spring 140 such that the spring supports the canopy 2' and urges it against decorative nut 130'.--

Please delete col. 7, line 39 through Col. 10, line 67 and insert the following:

--1. An ornamental carousel assembly of the type wherein a plurality of ornaments are mounted on a rotating ceiling plate comprising:

(a) a base;

(b) a wind-up type drive and music box mechanism secured to said base and including an output shaft;

(c) a tubular support assembly extending upright from and supported by said base;

(d) a ceiling plate rotatably supported on said tubular support assembly, said ceiling plate having means to support a plurality of ornaments; and, It is certified that error appears in the above-identified patent and that said Letters Patent is hereby corrected as shown below:

(e) drive transmitting means interconnected between said output shaft and said ceiling plate for rotating said ceiling plate relative to said tubular support assembly, the drive transmitting means including a one-way drive clutch mechanism such that the rotation of the output shaft in a first direction imports imparts rotation to the ceiling plate, while rotation of the output shaft in an opposite direction does not impart rotation to the ceiling plate.

2. The ornamental carousel assembly of claim 1 wherein said ceiling plate is rotatably supported on said tubular support assembly by a bearing means having an inner sleeve member non-rotatably secured to a support portion of said tubular support assembly and an outer rotary member rotatable with said ceiling plate.

3. The ornamental carousel assembly of claim 2 wherein said ceiling plate defines a cavity on the lower side thereof which snugly receives said outer rotary bearing member.

4. The ornamental carousel assembly of claim 1 further including a canopy and means for drivingly connecting the canopy to said drive transmittiung means for rotation therewith.

5. The ornamental carousel assembly of claim 4 wherein said means for drivingly connecting the canopy to said drive transmitting means includes a spring.

6. The ornamental carousel assembly of claim 1 wherein said drive transmission means comprises a drive transmitting rod drivingly connected to said drive output shaft and extending upwardly through said tubular support assembly and said ceiling plate.

It is certified that error appears in the above-identified patent and that said Letters Patent is hereby corrected as shown below:

7. The ornamental carousel assembly of claim 6 wherein the one-way drive clutch mechanism is operatively interposed between the drive transmitting rod and the output shaft such that rotation of the output shaft in a first direction imparts rotation to the drive transmitting rod, while rotation of the output shaft in an opposite direction does not impart rotation to the drive transmitting rod.

8. The ornamental carousel assembly of claim 7 wherein the one-way clutch mechanism comprises:

(a) a ratchet cog wheel drivingly associated with the drive transmitting rod, the ratchet cog wheel defining a plurality of ratchet teeth; and, (b) a ring drivingly associated with the output shaft and having at least one resilient arm extending therefrom, the at least one resilient arm having a drive tooth located so as to engage the ratchet teeth on said ratchet cog wheel.

9. The ornamental carousel assembly of claim 6 wherein said drive transmission means further comprises a drive transfer means including means drivingly engaged with said drive transmitting rod for imparting a reciprocating movement to said plurality of ornaments and rotary movement to said ceiling plate.

10. The ornamental carousel assembly of claim 9 wherein said drive transfer means comprises a gear drive assembly.

11. The ornamental carousel assembly of claim 10 wherein said gear drive assembly comprises:

(a) a first circular gear rack fixed to said tubular support assembly;

(b) a plurality of driven shafts rotatably supported on said ceiling plate, each of said driven shafts including a pinion gear fixed at one end thereof in engagement with said first gear rack;

It is certified that error appears in the above-identified patent and that said Letters Patent is hereby corrected as shown below:

(c) a second circular gear rack also engaged with said pinion gears and located above said first circular gear rack; and, (d) means drivingly connecting said second circular gear rack to said drive transmitting rod such that rotation of said drive transmitting rod by said output shaft causes rotation of said second circular gear rack, said driven shafts and said ceiling plate.

12. The ornamental carousel assembly of claim 11 further including a biasing spring located about a portion of said drive transmitting rod for biasing said second circular gear rack into engagement with said pinon gears.

13. The ornamental carousel assembly of claim 11 further comprising a disk secured to each of said driven shafts on an end opposite said pinion gear, each of said disks including an outwardly projecting stub shaft eccentrically offset from the axis of its respective driven shaft, said stub shaft engaging with a respective one of said means for mounting the plurality or ornaments such that rotation of said disk by said driven shaft results in a reciprocating movement of said ornaments.

14. An ornamental carousel assembly of claim 13 wherein each of said means for mounting an ornament comprises:

(a) a follower plate having a pair of guide sleeve portions being received about a pair of upstanding guide rails attached to said ceiling plate; and, (b) an elongated ornament support rod attached to said follower plate and including means for securing an ornament thereto.

CERTIFICATE OF CORRECTION

PATENT NO. : 5,203,743
DATED : April 20, 1993
INVENTOR(S) : Jack HOU

It is certified that error appears in the above-identified patent and that said Letters Patent is hereby corrected as shown below:

15. The ornamental carousel assembly of claim 14 wherein said follower plate is generally triangular in shape with said guide sleeve portions being located at two apexes of the triangle and said support rod being secured at the third apex.

16. The ornamental carousel assembly of claim 11 wherein the one-way drive clutch is operatively interposed between the drive transmitting rod and said second circular gear rack such that rotation of the drive transmitting rod in a first direction imparts rotation to said second circular gear rack, while rotation of the drive transmitting rod in an opposite direction does not impart rotation to the second circular gear rack.

17. The ornamental carousel assembly of claim 16 wherein said one-way drive clutch mechanism comprises:

(a) a ratchet cog wheel drivingly associated with the second circular gear rack, the ratchet cog wheel defining a plurality of ratchet teeth; and, (b) a ring drivingly connected to said drive transmitting rod and having at least one resilient arm extending therefrom, the at least one resilient arm having a drive tooth located so as to engage the ratchet teeth on said ratchet cog wheel.

18. The ornamental carousel assembly of claim 1 further comprising a canopy and a spring mounted for rotation with said drive transmitting means, wherein said spring supports said canopy for rotation.

19. The ornamental carousel assembly comrpising:

(a) a base unit;

(b) a power drive means carried by the base unit and including an output shaft;

It is certified that error appears in the above-identified patent and that said Letters Patent is hereby corrected as shown below:

(c) a generally vertically extending drive rod including upper and lower ends, the lower end being operatively associated with the output shaft of the power drive means for rotating the drive rod about a longitudinal axis;

(d) a support plate rotated by rotation of the drive rod;

(e) means carried by the support plate for mounting at least one decorative figure thereto;

(f) a canopy mounted on the drive rod near the upper end thereof such that the canopy may slide along the drive rod;

(g) stop means attached to the upper end of the drive rod; and, (h) biasing means operatively associated with the canopy so as to bias the canopy against the stop means.

20. The ornamental carousel assembly of claim 19 wherein biasing means comprises a spring.

21. The ornamental carousel assembly of claim 20 wherein the spring comprises a coil spring.

22. The ornamental carousel assembly of claim 21 wherein the coil spring is operatively interposed between the canopy and the support plate.

23. The ornamental carousel assembly of claim 21 further comprising a collar member fixedly attached to the drive rod such that the coil spring is operatively interposed between the canopy and the collar member.

UNITED STATES PATENT AND TRADEMARK OFFICE

CERTIFICATE OF CORRECTION

PATENT NO. : 5,203,743

DATED : April 20, 1993

INVENTOR(S) : Jack HOU

It is certified that error appears in the above-identified patent and that said Letters Patent is hereby corrected as shown below:

24. The ornamental carousel assembly of claim 21 wherein the coil spring comprises a compression coil spring.

25. The ornamental carousel assembly of claim 21 wherein the coil spring extends about the drive rod.

26. The ornamental carousel assembly of claim 23 further comprising a second collar member slidably mounted on the drive rod and operatively interposed between the coil spring and the canopy.--

Signed and Sealed this

Thirty-first Day of May, 1994

Bruce Lehman

*Attest:*

BRUCE LEHMAN

*Attesting Officer*

*Commissioner of Patents and Trademarks*